US007143699B2

(12) United States Patent
Brock et al.

(10) Patent No.: US 7,143,699 B2
(45) Date of Patent: Dec. 5, 2006

(54) LIQUID FILLED LESS LETHAL PROJECTILE

(75) Inventors: Christopher V. Brock, Marion, IL (US); Jaime H. Cuadros, Hacienda Heights, CA (US)

(73) Assignee: BNB Ballistics, Inc., Marion, IL (US)

( * ) Notice: Subject to any disclaimer, the term of this patent is extended or adjusted under 35 U.S.C. 154(b) by 177 days.

(21) Appl. No.: 10/827,000

(22) Filed: Apr. 19, 2004

(65) Prior Publication Data

US 2005/0229807 A1 Oct. 20, 2005

(51) Int. Cl.
*F42B 10/00* (2006.01)

(52) U.S. Cl. ..... 102/502; 102/513; 102/370

(58) Field of Classification Search ..... 102/502, 102/513, 370, 367, 512
See application file for complete search history.

(56) References Cited

U.S. PATENT DOCUMENTS

| | | | | |
|---|---|---|---|---|
| 1,741,901 | A | 12/1929 | Alden | |
| 3,429,263 | A | 2/1969 | Snyder et al. | |
| 3,502,025 | A | 3/1970 | Payne | |
| 3,650,213 | A * | 3/1972 | Abbott et al. | 102/436 |
| 3,733,727 | A | 5/1973 | Jones et al. | |
| 3,782,286 | A | 1/1974 | Jones et al. | |
| 3,791,303 | A * | 2/1974 | Sweeney et al. | 102/502 |
| 3,865,038 | A | 2/1975 | Barr | |
| 4,895,076 | A | 1/1990 | Looger et al. | |
| 4,899,660 | A | 2/1990 | Brighton | |
| 4,942,818 | A * | 7/1990 | Saxby | 102/444 |
| 5,001,880 | A * | 3/1991 | Smith | 53/453 |
| 5,009,164 | A * | 4/1991 | Grinberg | 102/502 |
| 5,009,165 | A | 4/1991 | Morris | |
| 5,035,183 | A * | 7/1991 | Luxton | 102/502 |
| 5,450,795 | A | 9/1995 | Adelman | |
| 5,652,407 | A | 7/1997 | Carbone | |
| 6,230,630 | B1 | 5/2001 | Gibson et al. | |
| 6,283,037 | B1 | 9/2001 | Sclafani | |
| 6,295,933 | B1 | 10/2001 | Dubocage et al. | |
| 6,374,742 | B1 | 4/2002 | Brunn et al. | |
| 6,393,992 | B1 | 5/2002 | Vasel et al. | |
| 6,615,739 | B1 * | 9/2003 | Gibson et al. | 102/513 |
| 2005/0016412 | A1 * | 1/2005 | Vasel et al. | 102/502 |
| 2005/0188886 | A1 * | 9/2005 | Vasel et al. | 102/502 |

* cited by examiner

*Primary Examiner*—Michelle Clement
(74) *Attorney, Agent, or Firm*—Lewis Brishois; Bisgaard & Smith LLP; Sanford Astor, Esq.

(57) ABSTRACT

A less lethal projectile to be fired from a launcher comprising a body having a concentric cavity to hold a fluid payload, a nose cap attached to the body, said nose cap having a plurality of slits therein, which will spread open upon impact, allowing the fluid to escape.

4 Claims, 4 Drawing Sheets

LIQUID FILLED LESS LETHAL PROJECTILE

BACKGROUND OF THE INVENTION

Kinetic energy impact less-lethal projectiles have been in use for over 30 years. The early less-lethal projectiles were square cloth bags or sacks filled with No. 9 lead shot. There were two sizes, a 12-ga. Shotgun round containing 40 grams of lead shot and a 37 mm size containing 150 grams of lead shot. These projectiles were fired at a muzzle velocity of 230 and 300 feet per second (fps), for the shotgun, and from 110 to 250 feet per second (depending on the range) for the 37 mm rounds. The muzzle kinetic energy was about 70 and 120 ft-lbs, for the shotgun and from 70 to over 320 ft-lbs for the 37 mm projectiles.

These projectiles were widely used by the law enforcement community after it was demonstrated by experiment that the energy delivered by the impact was below the level determined to be lethal by blunt trauma impact to the heart area. The bags were rolled up inside the shotshell of the 12 ga. Shotgun, and they unroll at about 20 feet from the muzzle. When the bags impacted at less than the unrolling distance, the area of contact was reduced to less than 1 inch, thus raising the energy per unit area to the point where the bag would penetrate into the body causing serious damage.

In the late 1990 a new form of bag was introduced. The "sock bag" as it became known, was fabricated from a coarsely woven fabric in the shape of a tube, hence the name, and filled with # 9 lead shot and tied with a string to form the bag leaving a tail to act as an stabilizer. These bags suffered from the same problem as the rolled-up square bags, when impacting at 20 feet range, the kinetic energy density was about 220 ft-lbs/square inch with some expansion and if fully expanded the kinetic energy density was about 160 ft-lbs/sq in. when launched at 300 fps. In comparison a square bag at the same velocity would have a kinetic energy density of about 66 ft-lbs/sq in, when fully expanded and launched at 300 fps. The kinetic energy density goes up to over 230 ft-lbs/sq. in. when the bag strikes the target while still rolled up.

A subsequent development introduced a foam projectile fired from a 40 mm launcher. This design abandoned the 12 gauge size in favor of the larger diameter impact area available from the larger diameter projectiles. The increased area of impact lowers the energy density and the compression of the foam nose lowers the sharpness of the impulse transmitted to the target individual at impact. A sharp impulse is more deleterious to tissue than a softer one.

SUMMARY OF THE INVENTION

The projectile of this invention consists of three principal parts: the body, the nose cap and an internal payload. The projectile is fired from a conventional 40 mm (or 37 mm in another embodiment) launcher using a conventional 40 mm (or 37 mm) cartridge. The body is made from a plastic (such as polyethylene) with an integral rotating band molded in. Other similar plastics can be utilized. The body has a concentric cavity that holds a liquid payload. The liquid is captured in the body by a frangible disk, made of plastic or cardboard, that obturates the cavity. The nose cap consists of a thin polyethylene shell with a plurality of slits partially cut on the front and side of the cap. This shell has a flat front end with rounded corners where it meets the cylindrical body. The nose cap collapses at impact and the slits cut in the side open up and remain open, forming a triangular (or rhomboidal) opening. The nose cap retains this deformation. This deformation also increases the diameter of the projectile to about 2.5 inches (as measured from clay impacts), which lowers the energy per unit area to the desired level (less than about 90 ft-lbs/sq in). In an alternate embodiment a polyethylene endoskeleton of the same shape as the nose cap, but of smaller diameter, is covered with a thin rubber cap with matching slits to the polyethylene cap. The endoskeleton opens the set of slits and holds them open permanently. The rubber cap or overlay is designed to lessen the impact and effect on bare skin.

The inertia of fluid that is encapsulated inside the body forces open (ruptures) the obturating disk at impact. The fluid continues moving forward and impinges on the inside of the nose cap and it is forced out radially through the open slits on the side of the cylindrical body. If the fluid contains a dye, the target individual will be marked for future identification and arrest, if warranted. Following standard practices, an irritant, such as OC (oleoresin Capsicum) or pepper extract, or CS or other tear gas solutions can be added to the fluid in the projectile to be dispersed at impact.

The fluid is a mixture of constituents that is adjusted to have a density of about 2. The basic fluid is glycerin but Vaseline or other similar fluid bases can be used as well. The density augmenting fluid used was barium sulfate, but other mixtures can be used, such as ferric oxide, copper powder or other heavy inorganic materials. The viscosity should be about the range of about 2000 to 500 centipoise. This level of viscosity is important in preventing the fluid from spinning inside the spinning projectile. If the fluid attains a sufficient level of spin it will de-stabilize the projectile causing it to tumble. Longitudinal vanes can be inserted inside the projectile body to reduce any fluid spin at the lower end of the usable viscosity.

The fluid mixture can be adjusted depending upon the desired application. The fluid mixture can be considerably less dense to utilize the projectile as a marking mechanism for structures, such as houses or buildings.

OBJECTS OF THE INVENTION

Accordingly, several objects and advantages of the invention are as follows:

An object of the present invention is to provide a less-lethal projectile which carries a liquid payload.

It is also an object of the present invention to provide a less-lethal projectile which can be used to mark the target individual.

A further object is to provide such a less-lethal projectile which carries a liquid payload and is stable in flight.

DETAILED DESCRIPTION OF THE INVENTION

Figure 1:
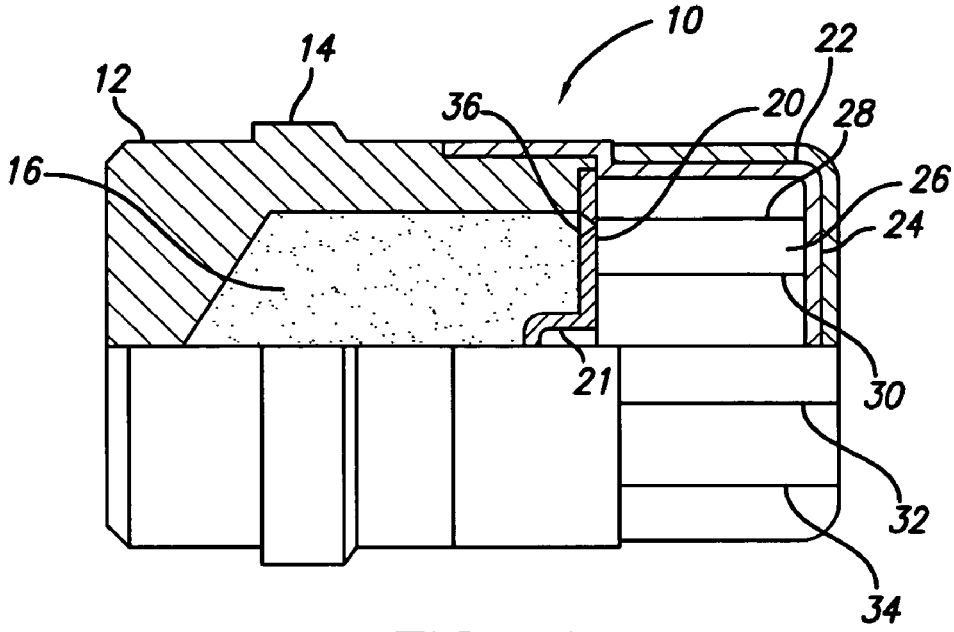
FIG. 1 is a side view, partially broken away, showing the projectile in flight.
Figure 2:
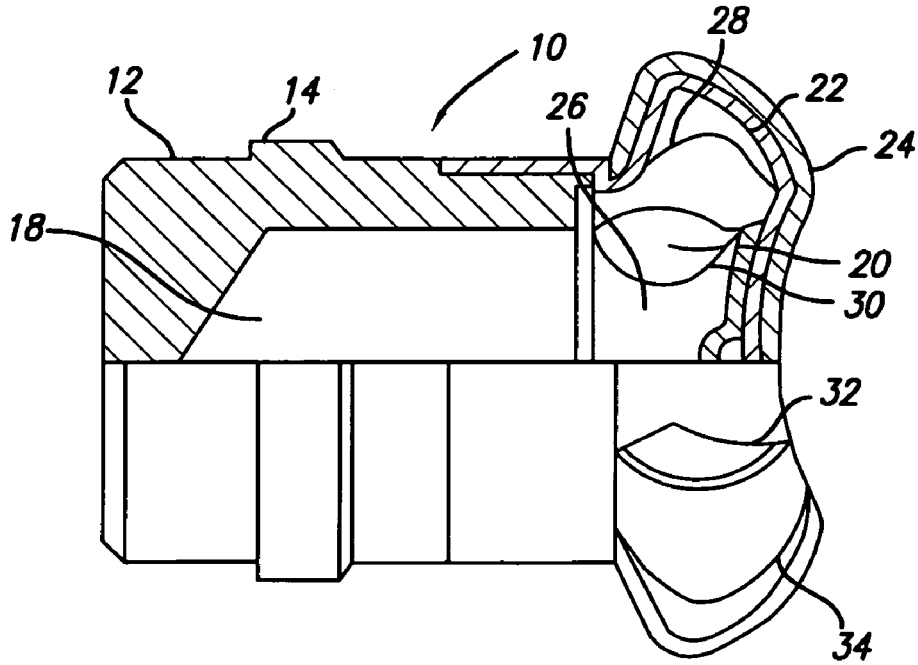
FIG. 2 is a side view, partially broken away, showing the projectile after impact.
Figure 3:
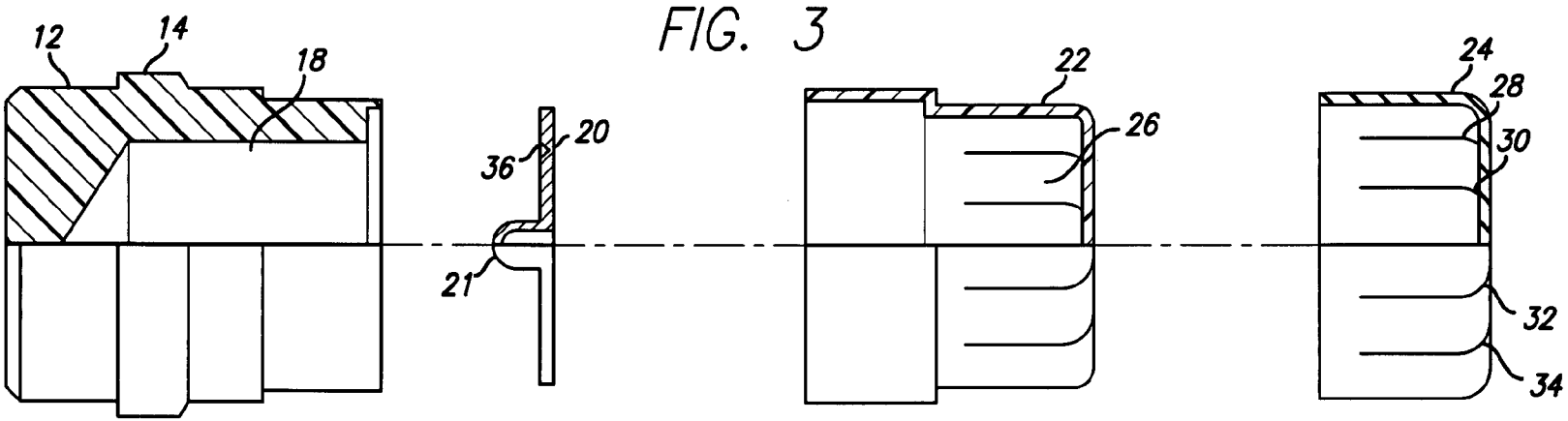
FIG. 3 is an exploded view of the embodiment of FIGS. 1 and 2.

Referring now to the drawings, there is shown in FIGS. 1, 2, and 3, a projectile 10 having a body 12 with rotating band 14 integral to the body 12. A supply of fluid 16 is contained within a cavity 18 inside of body 12. A frangible closure disk 20 holds fluid 16 in cavity 18. Frangible closure disk 20 has a circular groove 36, which provides a weak point, allowing closure disk 20 to break loose more easily on impact.

Frangible disk 20 has a small cylindrical projection 21 which projects into fluid cavity 18. Projection 21 acts as an expansion volume, molded into disk 20, where the fluid can expand, if the fluid is exposed to high storage temperatures. This expansion area is necessary, as fluid expansion, if not allowed for, would rupture disk 20 prior to launch or prior to impact.

An inner, hard-nosed cap 22 is attached to body 12 by an adhesive at assembly. An outer soft-nosed cap 24 covers hard-nosed cap 22. Soft-nosed cap 24 is bonded to hard-nosed cap 22 at manufacture as part of the molding process. There is an air gap or empty volume 26 between closure 20 and nose caps 22 and 24. Slits 28, 30, 32 and 34 are present in the surface of both caps 22 and 24. Slits 28, 30, 32 and 34 in hard and soft nose caps 22 and 24 are collinear, so that the slits coincide.

FIG. 1 shows the complete projectile 10 in flight. FIG. 2 shows projectile 10 after impact. Upon impact, the hard-nosed cap 22 is deformed and the force of the impact causes slits 28, 30, 32 and 34 to spread open, at which time the slits are permanently reformed to an open state. Soft-nosed cap 24 is bonded to hard-nosed cap 22 and the slits of soft-nosed cap 24 are spread open at impact, at the same time as the slits of hard-nosed cap 22.

On impact, closure disk 20 ruptures at weakened circular groove 36 by the inertia of fluid mass 16, and disk 20 is pushed against the inside of hard nose cap 22. Fluid 16 has escaped through open slits 28, 30, 32 and 34, and has splashed the target radially from the point of impact.

Figure 4:
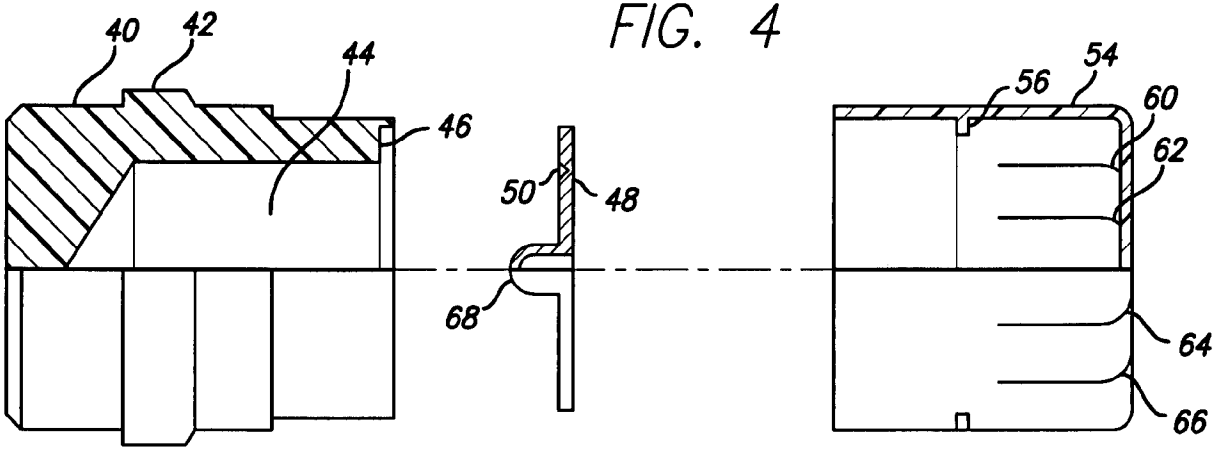
FIG. 4 is an exploded view of another embodiment.

Referring now to FIG. 4, there is shown another embodiment of the invention which involves the use of only one cap rather than the combination hard inner cap and soft outer cap. There is shown the body 40 with integral rotating band 42 molded in. A cavity 44 is located inside of the body to contain a liquid. Body 40 has a shoulder area 46 at the outer diameter, on which is seated frangible closure disk 48. Frangible disk 48 is held in place between shoulder 46 of body 40 and shoulder 56 of cap 54. Frangible disk 48 has a circular groove 50, which allows frangible disc 48 to break, from the force of the fluid contained in cavity 44 being thrust forward at the time of impact. This releases the fluid into cap 54. Cap 54 is made from a flexible but relatively stiff rubber material.

Cap 54 has a plurality of slits 60, 62, 64 and 66 which are deformed at impact and spread open, causing the fluid to escape through the open slits and splash the target radially from the point of impact, similar to the embodiment shown in FIGS. 1–3.

Frangible disk 48 has a small cylindrical projection 68 which projects into fluid cavity 44. Projection 68 acts as an expansion volume, molded into disk 48 where the fluid would expand if the fluid is exposed to high storage temperatures. This expansion area is necessary as fluid expansion, if not allowed for, would rupture disk 48 prior to launch or prior to impact.

Figure 5:
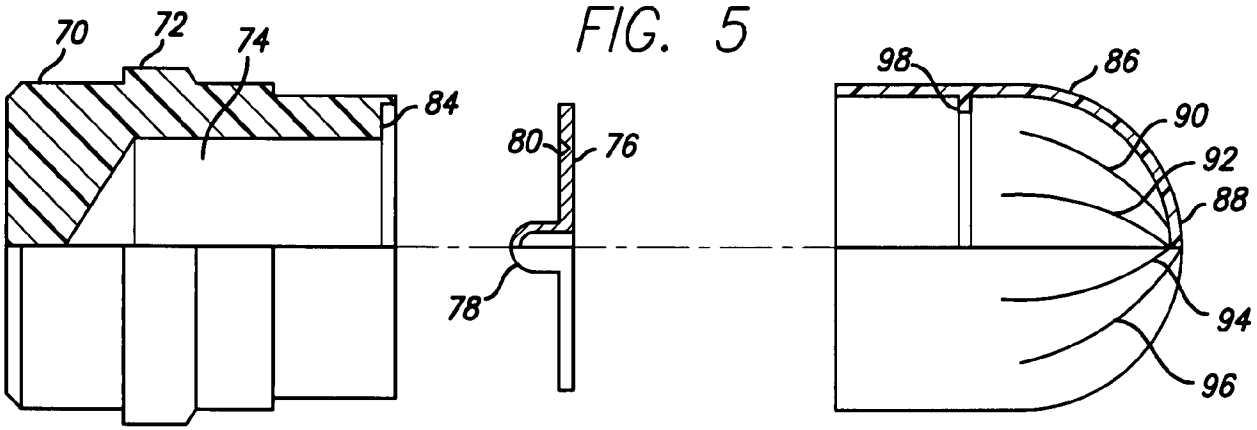
FIG. 5 is an exploded view of yet another embodiment.

Referring now to FIG. 5, there is shown another embodiment of the invention which comprises a projectile having a body 70 with a rotating band 72 integral to the body 70. The projectile has an open space or chamber 74 to hold a liquid, a frangible closure disk 76 having a cylindrical expansion area 78 and a circular groove 80, which are all similar to the embodiment shown in FIG. 4. Body 70 has an annular shoulder 84 for placement of frangible disk 76.

In this embodiment cap 86 is also made of a flexible, but fairly stiff, rubber material which has a rounded front surface 88. The rounded-front cap 86 may be more desirable in certain instances, relating to the effect of the impact on the target person. The rounded cap may do less damage to the target than the cap shown in the FIG. 4. Cap 86 has a series of slits as previously described, 90, 92, 94 and 96. Cap 86 also has an annular shoulder 98 for the seating of frangible disc 76, between shoulder 84 and shoulder 98. On impact, frangible disc 76 breaks at circular groove 80 and is thrust forward into the front of cap 86, releasing the liquid through slits 90, 92, 94, 96 which are spread open at the time of impact.

While only one cap is shown, the cap may also be made with the double cap structure of FIG. 1, comprising an inner hard nose cap and an outer soft nose cap adhered together, both caps having a rounded front.

Figure 7:
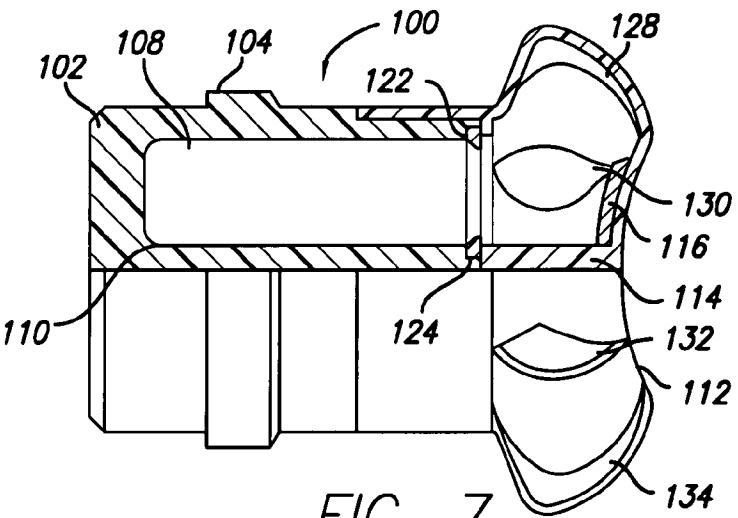
FIG. 7 is a side view, partially broken away, of the embodiment of FIG. 6 after impact.
Figure 6:
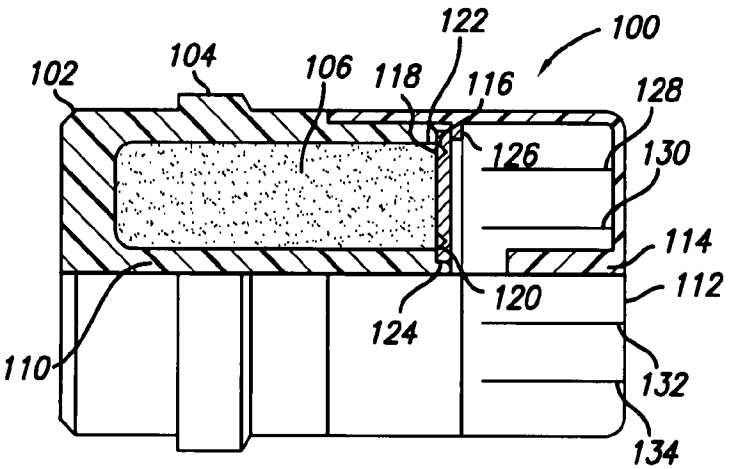
FIG. 6 is a side view, partially broken away, of another embodiment, before impact.

Referring now to FIG. 6 and FIG. 7 there is shown another embodiment of the invention, which shows a projectile 100 having a body 102 with a rotating band 104. Fluid 106 is contained in a chamber 108 within body 102. FIG. 6 describes the projectile prior to impact and FIG. 7 after impact.

In this embodiment, a central limiting column 110 is provided in body 102. Cap 112 has a second limiting column 114.

A frangible disk 116, having a circular groove 118, rests against two shoulders 122 and 124. Shoulder 122 is part of body 102 and shoulder 124 is located at the end of limiting column 110. Cap 112 has a plurality of slits 126, 128, 130 and 132.

Frangible disk 116 holds liquid 106 within chamber 108 of body 102. Disk 116 is held between shoulder 122 and shoulder 126 of cap 112. Frangible disk 116 has a central hole to fit over the end of limiting column 110.

On impact, liquid 106 is thrust forward breaking frangible disc 116 at circular grooves 118 and 120. On impact, frangible disk 116 breaks at both grooves 118 and 120 and is thrust forward into the inside of cap 112. On impact limiting column in cap 114 strikes against the end of limiting column 110 in body 102, which stops any further movement of the center of cap 112. Slits 128, 130, 132 and 134 are forced open and fluid 106 escapes through the open slits and splashes the target radially from the point of impact.

In the first embodiment shown, the inner cap is made of a plastic such as polyethylene. When polyethylene is used alone, it creates a sharp edge at the slits when they are forced open. To avoid potential injuries from the rotating projectile, a rubber nosecap is added to cover the sharp edges of the slits. It is necessary that the rubber nosecap not come in contact with the gun barrel as it is being launched. Any contact would change the launch dynamics, slowing down the projectile. Thus, the rubber cap is smaller in diameter than the body of the projectile, so that the rubber cap does not come in contact with the gun barrel as the projectile is being launched.

Figure 8:
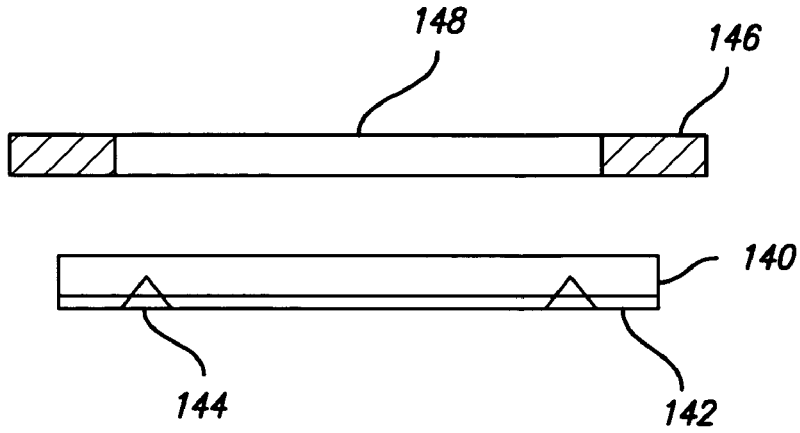
FIG. 8 is a side view of another type of closure disk system.

Referring now to FIG. 8, there is shown another embodiment of the frangible disk. In this embodiment, frangible disk 140 is made of cardboard with a polymer coating layer 142. Polymer layer 142 faces the liquid, so that the liquid does not penetrate disk 140. Disk 140 has a circular notch or groove 144 allowing it to break easily on impact. Because cardboard disk 140 is not as strong as a plastic disk used in the earlier embodiments, it is necessary to use a washer 146, having a large hole 148 through it, as support for disk 140.

Figure 9:
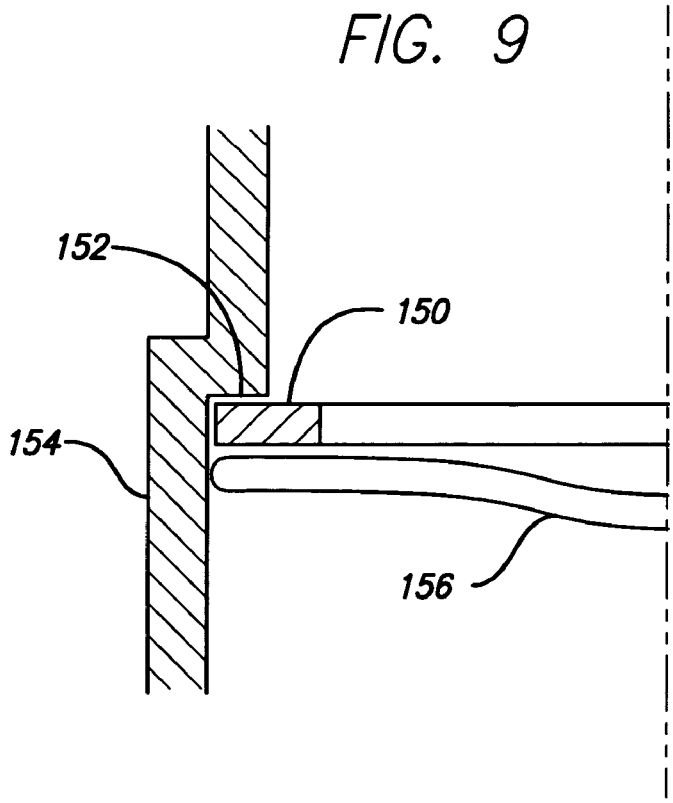
FIG. 9 is a side view of another embodiment of the disk of FIG. 8.

FIG. 9 shows a washer 150 resting against shoulder 152 of cap 154. Frangible cardboard disc 156 has a concave shape, facing washer 150. A shoulder of the body of a projectile will press against disk 156 holding it firmly against shoulder 152. The concave shape of disk 156 is to provide for expansion of the liquid in the projectile against disk 156. In the event the liquid in the projectile is exposed to high storage temperatures, disk 156 will be pushed forward, towards washer 150, so that disk 156 will not fracture prior to impact.

We claim:

1. A less lethal projectile to be fired from a launcher comprising, a body having a concentric cavity to hold a fluid payload, a nose cap attached to the body, said nose cap comprising an inner hard nose cap covered by an outer soft nose cap and having a plurality of slits therein, which will open upon impact, allowing the fluid to escape.

2. The projectile of claim 1 in which the inner cap and the outer cap have matching collinear slits.

3. A less lethal projectile comprising a body having a concentric cavity to hold a fluid payload, a nose cap attached to the body said nose cap having a plurality of slits therein which will spread open upon impact, a frangible disk to seal the fluid in the cavity in the body, said frangible disk rupturing at impact allowing the fluid to pass into the nose cap and escape through the slits in the nose cap in which the nose cap comprises an inner hard nose cap covered by an outer soft nose cap.

4. A less lethal projectile comprising a body having a concentric cavity to hold a fluid payload, a nose cap attached to the body said nose cap having a plurality of slits therein which will spread open upon impact, a frangible disk to seal the fluid in the cavity in the body, said frangible disk rupturing at impact allowing the fluid to pass into the nose cap and escape through the slits in the nose cap in which the frangible disk has a circular groove cut therein to provide a weakened point of rupture.

* * * * *